US012338636B2

(12) United States Patent
Stackhouse et al.

(10) Patent No.: US 12,338,636 B2
(45) Date of Patent: Jun. 24, 2025

(54) NICKEL-GAP FLAT SIDING PRODUCT WITH LOCKING JOINT

(71) Applicant: LOUISIANA-PACIFIC CORPORATION, Nashville, TN (US)

(72) Inventors: David L. Stackhouse, Nashville, TN (US); Matthew E. Vrazel, Nashville, TN (US); Jack J. Johnson, Jr., Newberry, MI (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 125 days.

(21) Appl. No.: 18/097,447

(22) Filed: Jan. 16, 2023

(65) Prior Publication Data

US 2023/0228099 A1 Jul. 20, 2023

Related U.S. Application Data

(60) Provisional application No. 63/299,844, filed on Jan. 14, 2022.

(51) Int. Cl.
*E04F 13/08* (2006.01)

(52) U.S. Cl.
CPC ..... *E04F 13/0894* (2013.01)

(58) Field of Classification Search
CPC ... E04F 13/0894; E04F 13/0864; E04F 13/10; E04F 13/0846; E04F 2201/026
See application file for complete search history.

(56) References Cited

U.S. PATENT DOCUMENTS

| | | | | |
|---|---|---|---|---|
| 4,825,618 | A * | 5/1989 | Blevins | E04F 13/142 52/541 |
| 7,934,352 | B1 * | 5/2011 | Mollinger | E04F 17/00 52/545 |
| 8,205,403 | B2 | 6/2012 | Myers et al. | |
| 9,140,018 | B2 | 9/2015 | Southwell | |
| 10,920,429 | B2 | 2/2021 | Shaw | |
| 2007/0062148 | A1 * | 3/2007 | Nienhuis | E04F 15/02033 52/592.1 |
| 2007/0261353 | A1 | 11/2007 | Cullen | |
| 2014/0345226 | A1 * | 11/2014 | Southwell | E04F 13/076 52/506.01 |

(Continued)

FOREIGN PATENT DOCUMENTS

KR 20060062088 A 6/2006

OTHER PUBLICATIONS

International Search Report and Written Opinion, PCT/US23/10873, Lousiana-Pacific Corp. (international filing date Jan. 16, 2023).

*Primary Examiner* — Gisele D Ford
(74) *Attorney, Agent, or Firm* — Wayne Edward Ramage; Baker Donelson

(57) ABSTRACT

A unique modified shiplap joint with matching or corresponding reverse curves on opposing edges or ends of a piece of siding, each forming one-half of the joint: an underlap edge, and an overlap edge. The respective curves engage and resist or prevent separation of the edges, particularly under a pre-determined wind load. A fastener channel in the underlap section allows for a nail or fastener to be used, while the nail head is then covered by the adjacent overlap section. The respective edges form an angled gap, which is configured to prevent water or rain from entering.

16 Claims, 10 Drawing Sheets

(56) References Cited

U.S. PATENT DOCUMENTS

| | | | | |
|---|---|---|---|---|
| 2015/0047281 | A1* | 2/2015 | Cole | E04B 1/762 52/302.1 |
| 2019/0309525 | A1* | 10/2019 | Santarossa | E04F 19/064 |
| 2020/0141123 | A1 | 5/2020 | Hurtubise et al. | |
| 2022/0098876 | A1* | 3/2022 | MacPherson | E04F 13/0864 |
| 2023/0024890 | A1* | 1/2023 | Boucké | E04F 13/0894 |

* cited by examiner

ENLARGED DETAIL 1

ENLARGED DETAIL 2

FRONT ISOMETRIC VIEW

NICKEL-GAP FLAT SIDING PRODUCT WITH LOCKING JOINT

This application claims benefit of and priority to U.S. Provisional App. No. 63/299,844, filed Jan. 14, 2022, which is incorporated herein in its entirety by specific reference for all purposes.

FIELD OF INVENTION

This invention relates to a "nickel-gap" flat siding product with a unique locking reverse curve shiplap joint attachment.

BACKGROUND OF INVENTION

Flat siding is an exterior cladding product that may be installed in horizontal, vertical or diagonal orientations. It may be installed fully flush with the wall. It may come in various dimensions (e.g., ½" thick×8" wide×16' long), with various surface textures (e.g., smooth, cedar, and the like). It may be fashioned of various materials, including, but not limited to, sawn wood, engineered wood composites of various types, cellulose fiber cement, or combinations thereof. Oriented, multilayer wood strand boards of the above-described type, and examples of processes for pressing and production thereof, are described in detail in U.S. Pat. Nos. 3,164,511, 4,364,984, 5,435,976, 5,470,631, 5,525,394, 5,718,786, 6,461,743, and U.S. patent application Ser. No. 17/747,930, all of which are incorporated herein in their entireties by specific reference for all purposes.

Installation of flat siding products present a unique challenge when the aesthetic desire for a "blind nail" attachment (i.e., the nail head is not visible and does not penetrate the outer surface of the siding) is coupled with the engineering need to meet local building code requirements for specified wind loads (i.e., so that adjacent pieces remain fully flush on the wall and resist being pulled away or detached from the wall). A modified form of a tongue-and-groove joint has the potential to solve this problem, but the siding thickness must be increased to allow for the machining of the joint. This is problematic from a cost, weight, and fastener capacity viewpoint.

Accordingly, what is needed is a siding joint that provides a "blind nail" attachment and the ability to withstand specified wind loads without an increase in siding thickness.

SUMMARY OF INVENTION

In various exemplary embodiments, the present invention comprises a unique modified shiplap joint with matching or corresponding reverse curves (S-curve), where two simple curves turn in opposite directions (e.g., a first curve followed immediately by a second curve in the opposite direction). The point where the curves meet is the point of reverse curvature.

The opposing edges or ends of a piece of flat siding comprise one-half of the modified shiplap joint: an underlap edge, and an overlap edge. In a horizontal configuration, the underlap is the top edge of the siding, and the overlap is the lower edge of the siding, so that when two siding pieces are assembled, any water or moisture on the exterior of the siding will run down the exterior side or face of the siding, and not enter or flow into the joint and thus potentially get behind the siding. The modified shiplap joint may also be used in a vertical configuration.

The reverse curves have several advantages over a straight cut or line angle, or linear or rectilinear configuration. The end of each curve at the respective face does not come to a sharp point, as would a straight cut, and thus is stronger and less likely to break off. The curves themselves provide stronger and more stable connectivity between the siding edges, thereby providing greater resistance to wind and similar environmental factors. Further, the reverse curve shape allows the joint to function properly with partial contact, even if the siding pieces are not fully pushed adjacent. In contrast, a straight cut or line angle requires the siding pieces to be in contact along their face, and a partial insertion results in little or no contact, weakening the joint. In addition, in several embodiments the reverse curve feature allows the gap between successive courses of siding to vary without reducing the wind load ratings of the siding.

On the exterior face, the forward edge of the overlap, and the back edge of the underlap, are angled (they are supplementary angles, so that together they add to 180 degrees). The length of the back face of the overlap portion is slightly shorter than the front face of the underlap portion, so that when the joint is formed, a gap appears on the front face (i.e., commonly referred to as a "nickel gap"). The forward and back edges are parallel, and thus form a constant-width gap. The relative lengths of the overlap and underlap portions can be set to achieve a desired gap width. While the gap may be angled in any direction (e.g., upward, downward, or orthogonal with respect to the exterior face(s)), in an exterior horizontal configuration, the gap typically would be directed downward when assembled, so that any water or moisture on the exterior of the siding will run down the exterior side or face of the siding, and not enter or flow into the joint and thus potentially get behind the siding, as discussed above.

In some embodiments, one or both of the forward and/or back edge angles may vary slightly so as to not be precisely supplementary, and chosen so that the gap may reduce in width from the outer surface. Further, the angles may be opposing, so as to form a V-shape or notch when assembled.

The outer or front face of the underlap further comprises a fastener groove or channel extending linearly parallel to the edge for some or all of the corresponding length of the piece of siding. A nail or other fastener is driven into this groove or channel when the siding is mounted on a frame or sheathing, and forms a "blind nail" attachment when the overlap end of the adjacent piece of siding is placed over this area (and thus the nail head cannot be seen). The depth of the groove or channel is such as to accommodate the nail or fastener head (i.e., the top of the nail or fastener head does not extend above the outer or front face of the underlap), and allows the overlap portion, and thus the siding, to lie flat.

The modified shiplap joint thus ensures that the two adjacent pieces of siding of standard thickness are properly and adequately connected to each other, and, through the nail in the underlap portion of the joint, to the wall. The joint connection thus is strong enough to withstand specified wind loads without an increase in joint or overall thickness of the pieces of siding.

DETAILED DESCRIPTION OF EXEMPLARY EMBODIMENTS

Figure 1:
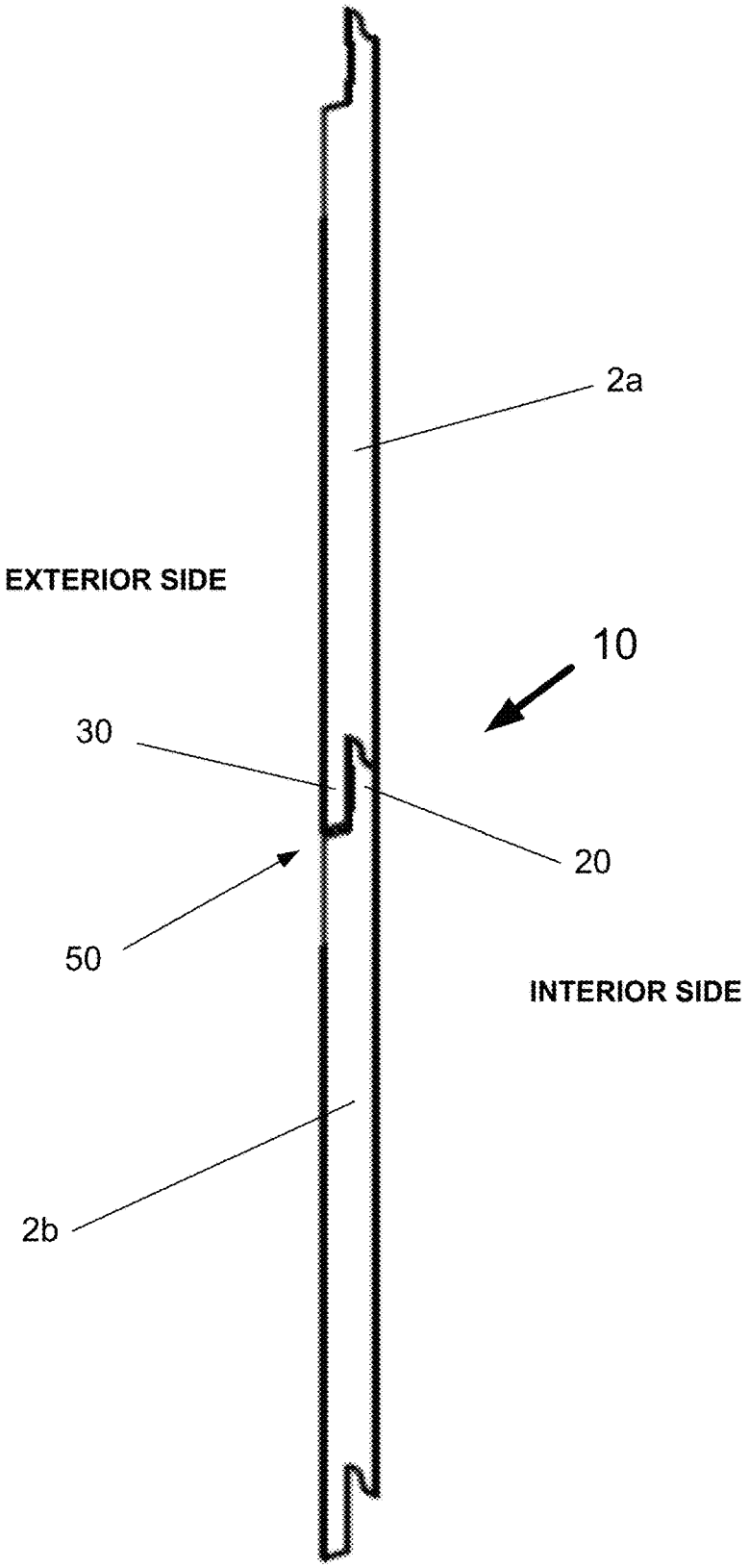
FIG. 1 shows a cross-section view of two siding products forming a modified shiplap joint in accordance with an embodiment of the present invention.
Figure 2:
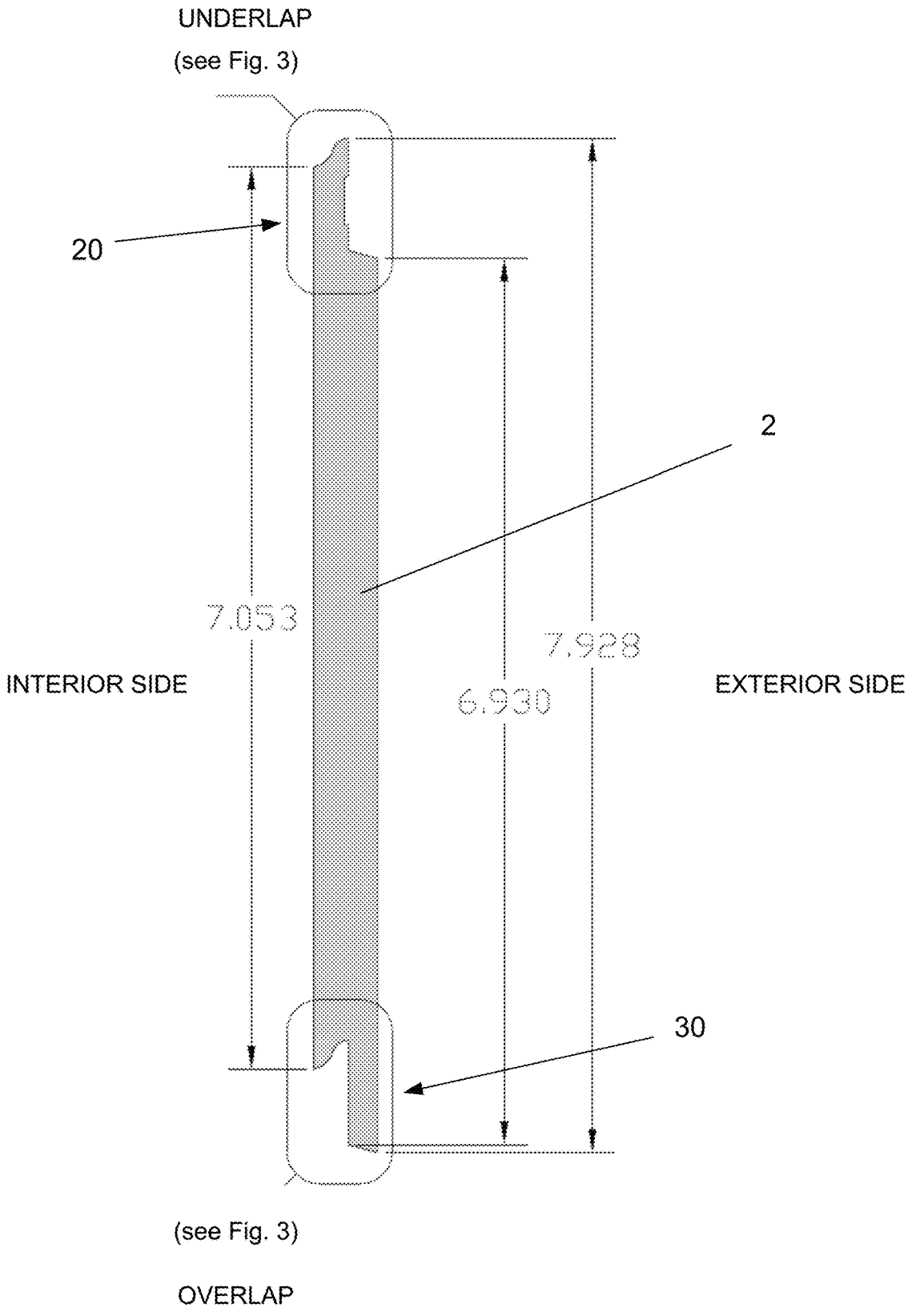
FIG. 2 shows a cross-section view of one of the siding products in FIG. 1.
Figure 3:
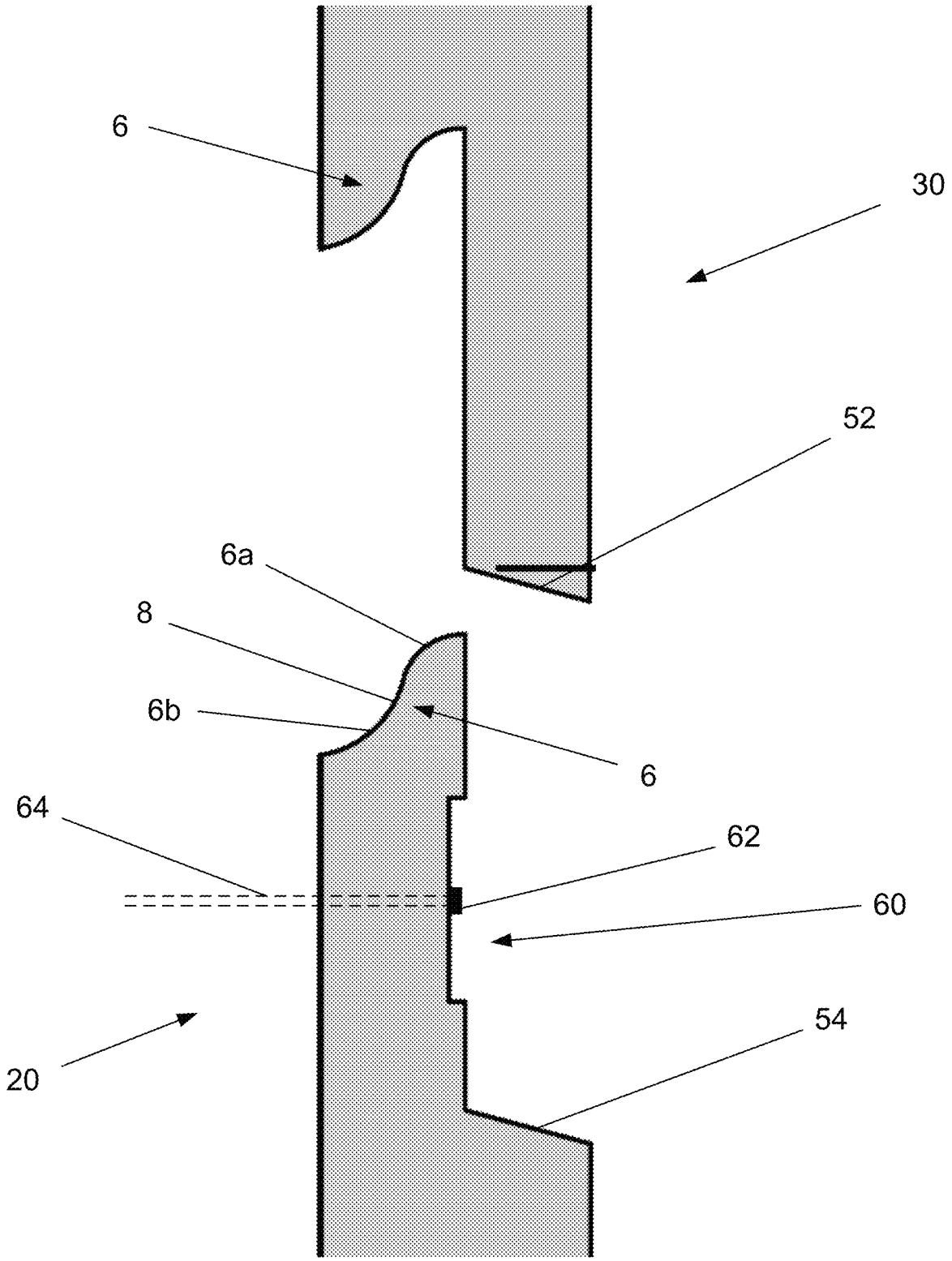
FIGS. 3-6 shows detailed cross-section views of the overlap and underlap edges of FIG. 1.

In various exemplary embodiments, as seen in FIGS. 1-3, the present invention comprises a unique modified shiplap joint 10 with matching and/or corresponding reverse curves (S-curve) on the respective edges (or ends) of two adjacent pieces of siding 2*a, b*. Each reverse curve 6 comprises two simple curves turning in opposite directions (e.g., a first curve 6*a* followed immediately by a second curve 6*b* in the opposite direction). The point in the reverse curve where the first and second curves meet is the point of reverse curvature 8.

The opposite or opposing edges or ends of a piece of flat siding 2 comprise one-half of the modified shiplap joint: an underlap edge 20, and an overlap edge 30. In a horizontal configuration (i.e., where the piece of flat siding extends horizontally along the wall or structure) the underlap 20 is the lower edge, and the overlap 30 is the top edge, so that when assembled, any water or moisture on the exterior of the siding will run down the exterior side or face of the siding, and not enter or flow into the joint and thus potentially get behind the siding.

The reverse curves 6 have several advantages over a straight cut or line angle, or linear or rectilinear configuration. The end of each curve at the respective face does not come to a sharp point, as would a straight cut, and thus is stronger and less likely to break off. The curves themselves provide stronger and more stable connectivity between the siding edges, thereby providing greater resistance to wind and similar environmental factors. Further, the reverse curve shape allows the joint to function properly with partial contact, even if the siding pieces are not fully pushed adjacent. In contrast, a straight cut or line angle requires the siding pieces to be in contact along their face, and a partial insertion results in little or no contact, weakening the joint. In addition, in several embodiments the reverse curve feature allows the gap between successive courses of siding to vary without reducing the wind load ratings of the siding.

Figure 4:
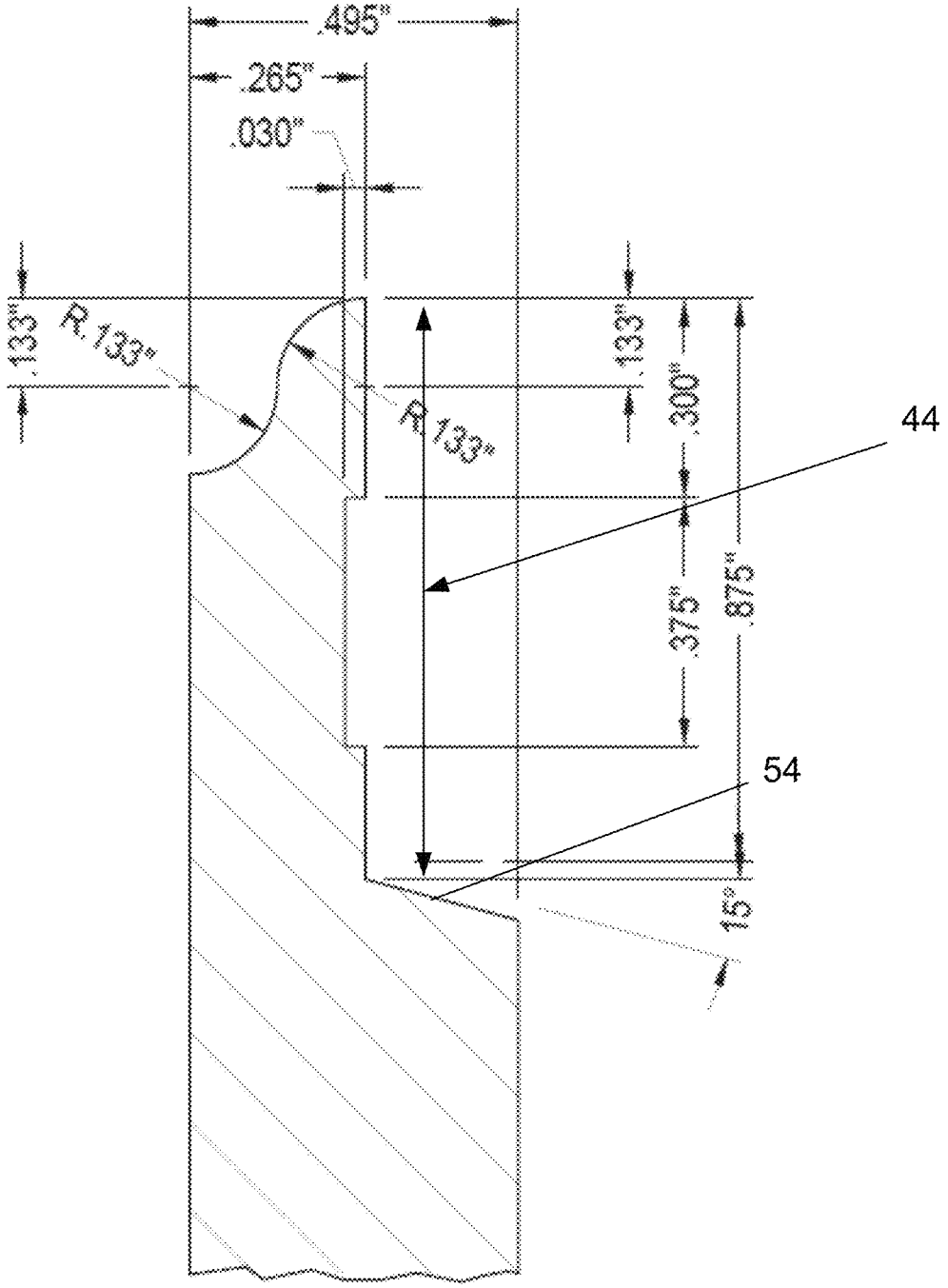
Figure 5:
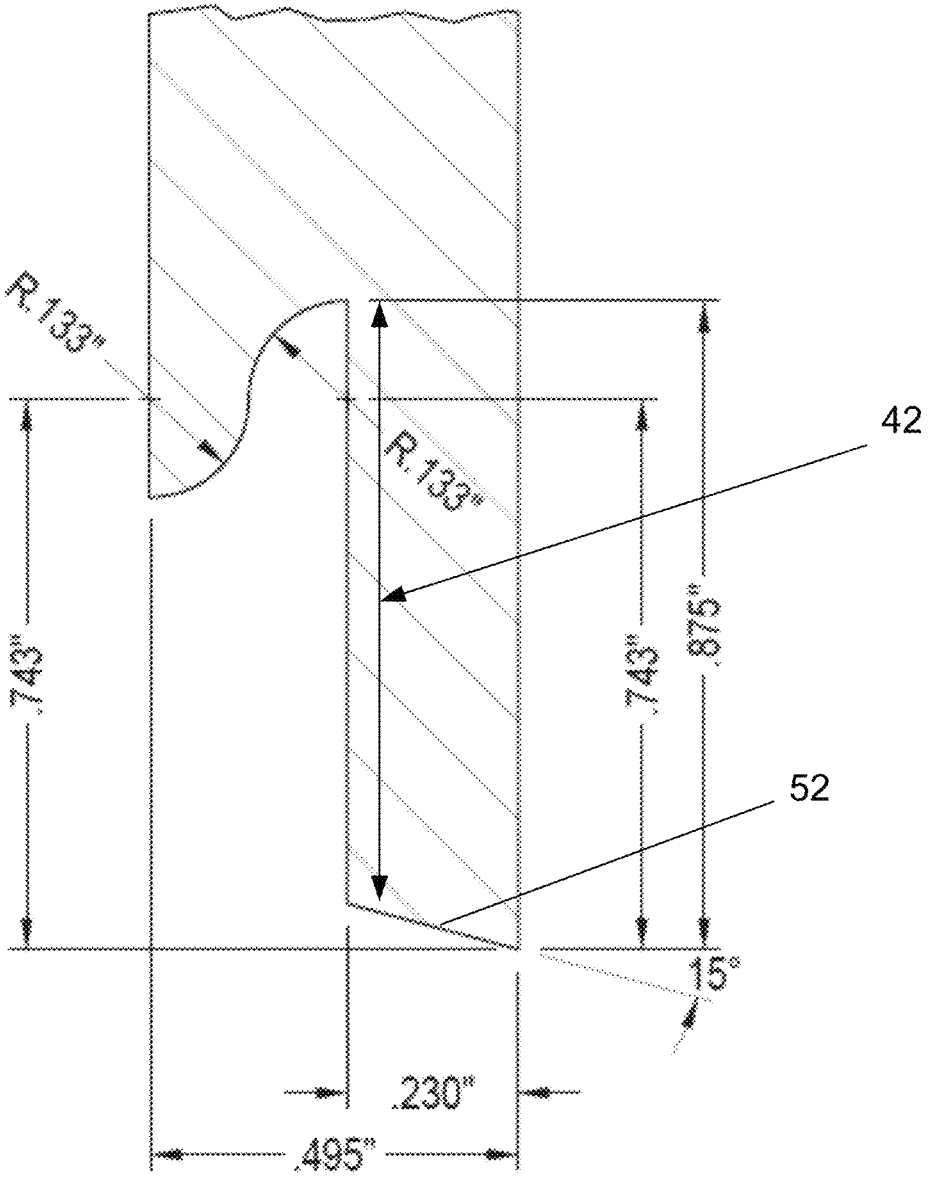
Figure 6:
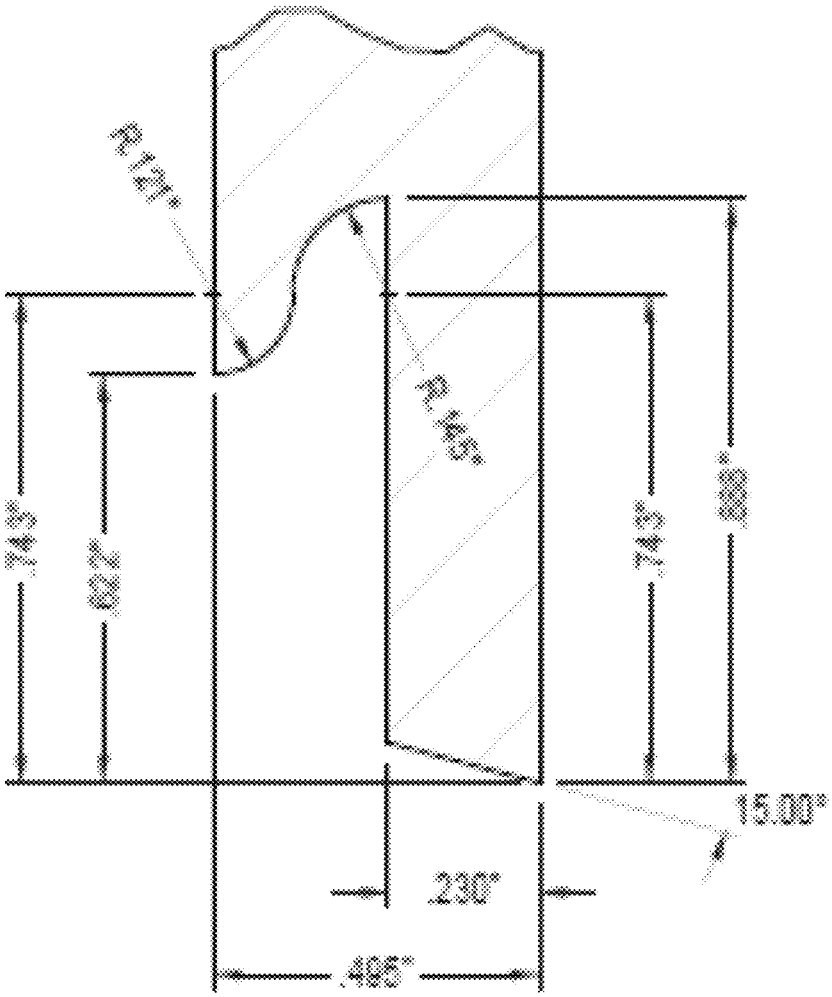

The first curve and second curve that make up a single reverse curve may have the same radii of curvature, or different radii of curvature. Likewise, the corresponding curves of the reverse curves on the respective edges that form the joint may have the same radii of curvature, or different radii of curvature. In FIGS. 4 and 5, for example, the radii of curvature is same for all four corresponding curves. FIG. 6 shows an example where the first curve and the second curve of the overlap section have different radii of curvature, and both are different from radii of curvature of the first and second curves in the reverse curve of the underlap section (see FIG. 4).

The slight variation in the radius of curvature helps ensure that there is sufficient engagement between the two reverse curves, even when the two edges are not completely matched. Thus, in the embodiment represented by the underlap section of FIG. 4 and the overlap section of FIG. 6, the first curve of the overlap section of FIG. 6 (adjacent to the interior face) has a smaller radius of curvature than that of the corresponding first curve in the underlap section of FIG. 4 (adjacent to the interior face), while the second curve of the overlap section of FIG. 6 has a larger radius of curvature than that of the corresponding second curve in the underlap section of FIG. 4. During installation, the underlap section (FIG. 4) will be already fastened to the wall or other structure (as discussed below). The first curve of the overlap section (FIG. 6) will be inserted first, and its smaller radius of curvature, and the larger radius of curvature of the second curve, will help with the ease and depth of insertion, and ensure sufficient contact and engagement between the joint elements.

On the exterior face, the forward edge 52 of the overlap and the back edge 54 of the underlap, are angled. In the embodiment shown, in FIGS. 4 and 5, they are supplementary angles with respect to their exterior faces, so that together they add to 180 degrees. The angle of the cut on the underlap back edge 54 is 75 degrees with respect to the exterior face (which is 15 degrees from the transverse orthogonal plane across the thickness of the piece of siding). The angle of the cut on the overall back edge is 105 degrees with the respect to the exterior face (which likewise is 15 degrees from the transverse orthogonal plane).

The length of the back face 42 of the overlap portion is slightly shorter than the front face 44 of the underlap portion, so that when the joint is formed, a gap 50 appears on the exterior or front face (i.e., commonly referred to as a "nickel gap"). The forward edge 52 and back edge 54 are parallel in this embodiment, and thus form a constant-width gap, determined by the difference in length of back face 42 and front face 44. The relative lengths can be set to achieve a desired gap width. In several embodiments, the gap width may be 1/32", 1/16", 1/8", or another width as desired. While the gap may be angled in any direction (e.g., upward, downward, or orthogonal with respect to the exterior face(s)), in an exterior horizontal configuration, the gap typically would be directed or angled downward with respect to the exterior face when assembled, so that any water or moisture on the exterior of the siding will run down the exterior side or face of the siding, and not enter or flow into the joint 10 and thus potentially get behind the siding, as discussed above.

Figure 7:
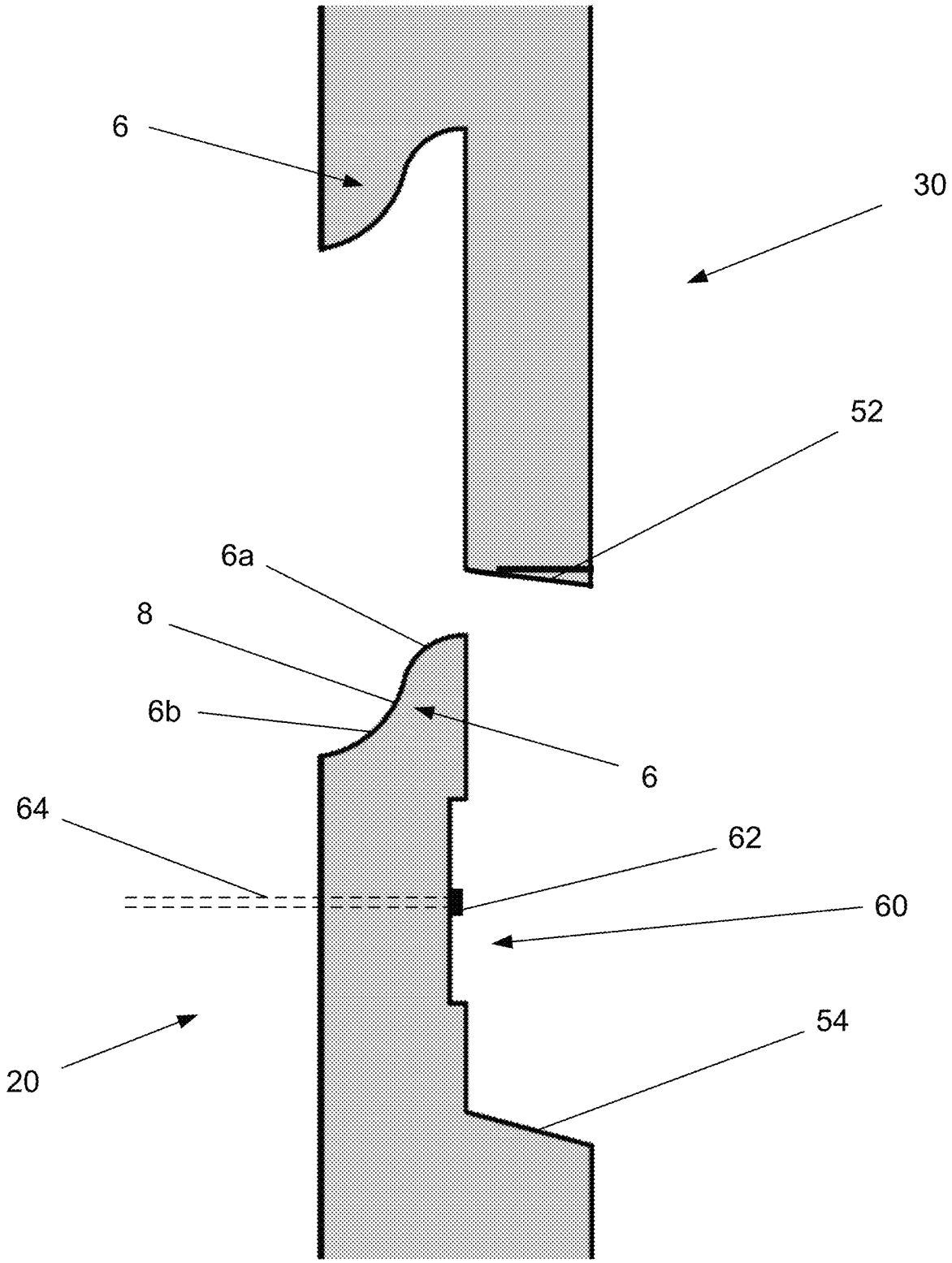
FIGS. 7 and 8 show cross-section views with alternative angles on the front edge of the overlap section.
Figure 8:
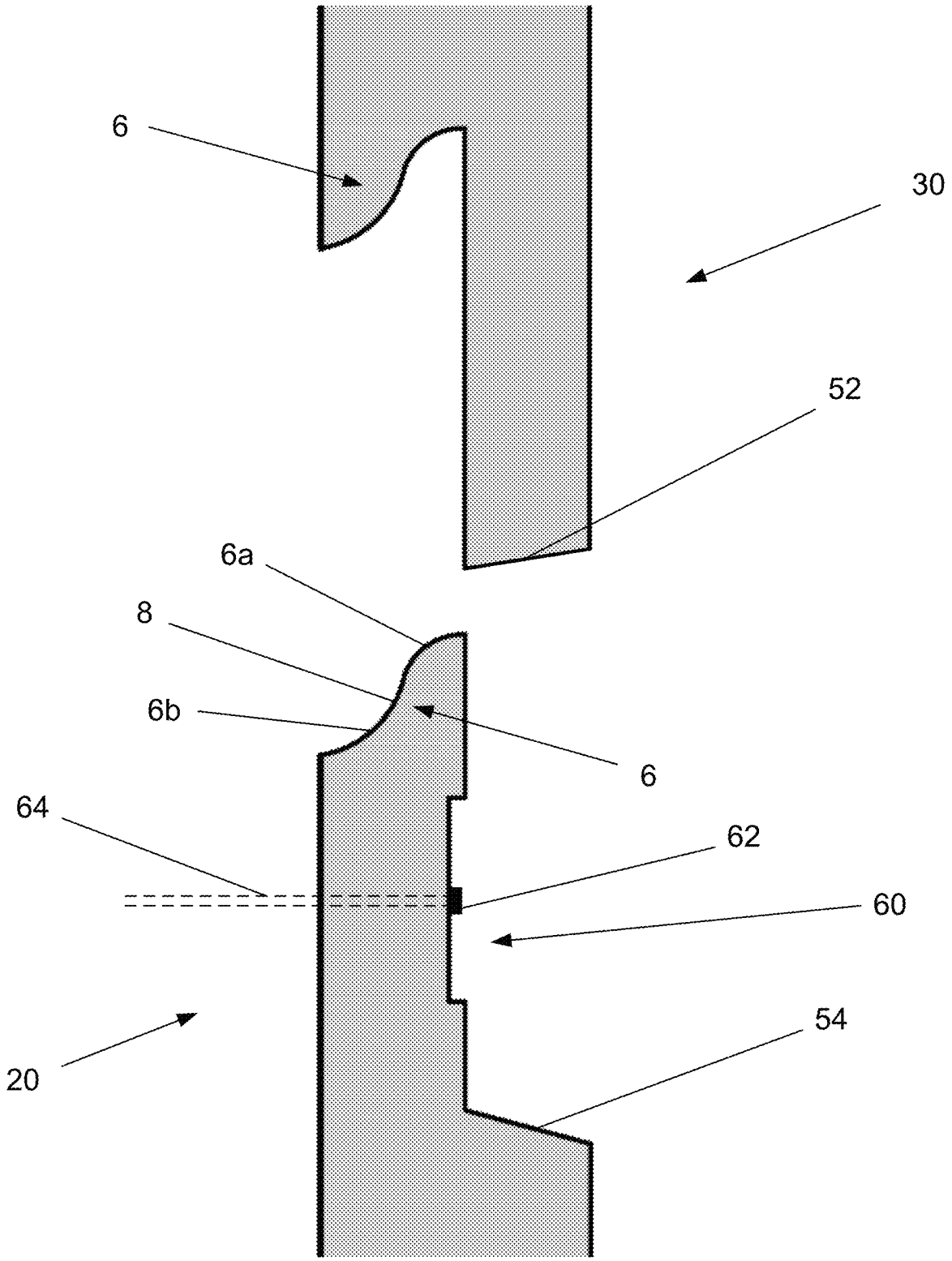

In some embodiments, one or both of the forward and/or back edge angles may vary slightly so as to not be precisely supplementary, and chosen so that the gap may reduce in width from the exterior face or surface. FIG. 7 shows the forward edge 52 and back edge 54 with an approximately 2.5 degree difference, so that the gap reduces in width from the exterior face. In alternative embodiments, the difference in angles may be such that they appear to be opposing, as seen in FIG. 8, so as to form a V-shape or notch when assembled.

The front face 44 of the underlap further comprises a fastener groove or channel 60 extending linearly parallel to the edge for some or all of the corresponding length of the piece of siding. A nail or other fastener 62 is driven into this groove or channel 60 when the piece of siding is mounted on a frame or sheathing, and forms a "blind nail" attachment when the overlap end of the adjacent piece of siding is placed over this area (and thus the nail head 64 cannot be seen). The depth of the groove or channel is such as to accommodate the nail or fastener head 64 (i.e., the top of the nail or fastener head does not extend above the front face 44 of the underlap), and allows the overlap portion, and thus the adjacent pieces of siding, to lie flat when the joint 10 is formed.

The modified shiplap joint 30 thus ensures that the two adjacent pieces of siding are properly and adequately connected to each other, and, through the nail in the underlap portion of the joint, to the wall. The unique configuration of the joint allows a "blind nail" attachment while being strong enough to withstand specified wind loads without an increase in joint or overall thickness of the pieces of siding.

Figure 9:
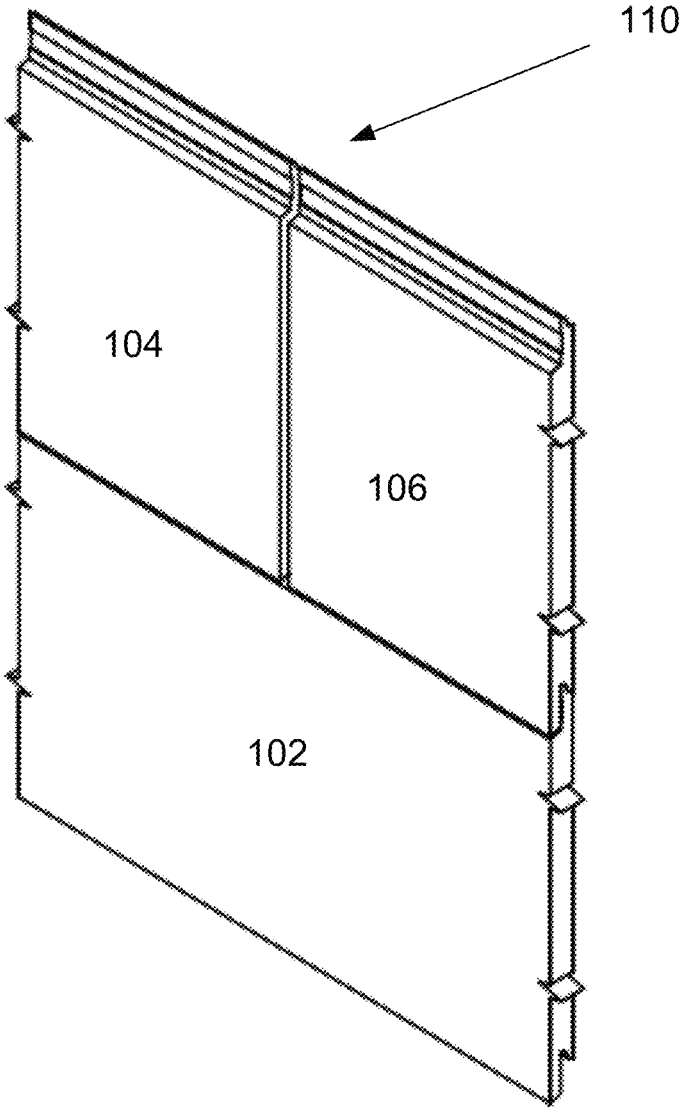
FIGS. 9-10 show perspective views of multiple pieces of siding installed on a wall.
Figure 10:
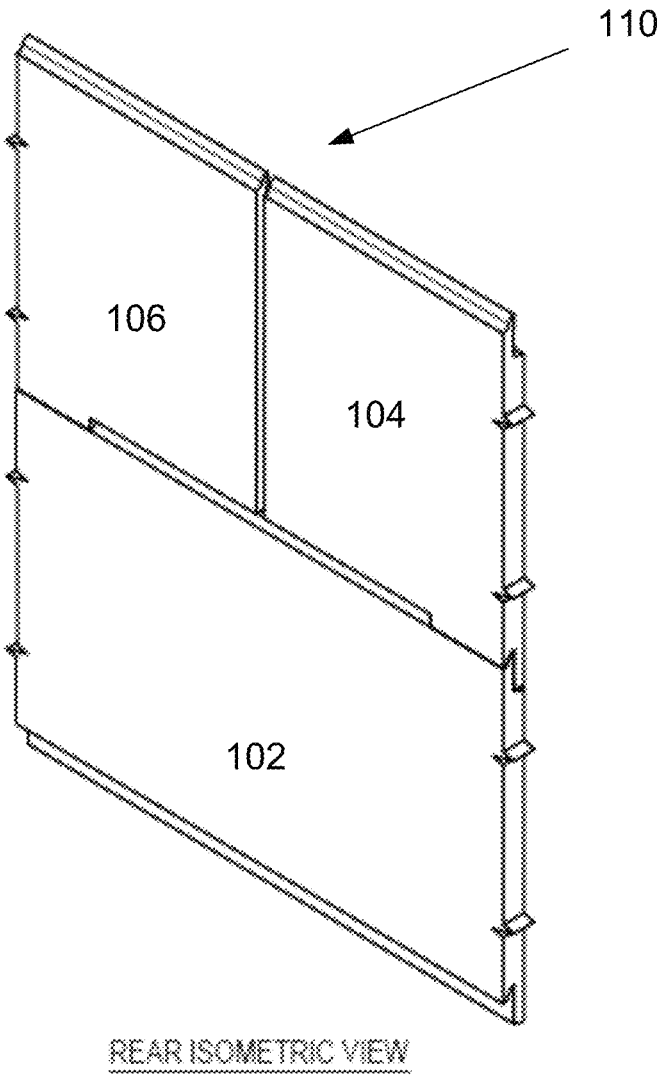

An example of the installation process, to produce an assembly as seen in FIG. 9 (which shows partial portions of siding pieces), would proceed as follows: (1) a lower piece of siding 102 is installed and fastened to the wall with the underlap edge or part of the joint facing up; (2) and an upper piece of siding 104 is placed above the lower piece and moved downward so the reverse curve machined on the overlap part of the joint along the bottom edge of the upper piece enters and engages the corresponding recessed reverse curve machined into the back of the underlap part of the joint. Where the end joints 110 between siding pieces on the same level do not align (i.e., are offset) with end joints on the adjacent levels, a second upper piece of siding 106 is placed above the lower piece, and adjacent to the end of the first upper piece 104, and moved downward so the reverse curve machined on the overlap part of the joint along the bottom edge of the second upper piece 106 enters and engages the corresponding recessed reverse curve machined into the back of the underlap part of the lower piece of siding 102. The joint between the ends of the pieces of the siding on the same level (e.g., 104, 106) typically form butt joints, but other joint configurations may also be used. The butt (or other) joints may be flashed and/or sealed. Variations of this process may be used for vertically-aligned or diagonally-aligned siding.

The present invention thus positively locates and positions adjacent rows of siding, interlocking them and assisting in securely attaching the siding to the wall. This is especially valuable in high wind zones where additional face-penetrating nails or similar fasteners would be required absent the use of the present invention. An additional feature of the present invention is resistance to the penetration of moisture (e.g., wind-driven rain) and flames (e.g., an exterior wildfire event). The only penetration through the siding is hidden behind the overlap section of the adjacent piece of siding, and as discussed above, the direction of the gap downward resists and/or prevents the flow of rain and water through the fastener penetrations, or into the gap and joint itself.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A siding system, comprising:

a pair of siding pieces, each piece comprising a length, a width, an exterior face, an interior face, a first edge with a first recess cut with a first recess face parallel to and open to the interior face, and a second edge with a second recess cut with a second recess face parallel to and open to the exterior face, wherein the first edge of one panel is configured to meet with and form a shiplap joint with the second edge of the other panel;

the first edge further comprising an overlap reverse curve face extending from an interior corner of the first recess cut to the interior face, and an overlap front face extending from an exterior corner of the first recess cut to the exterior face;

the second edge further comprising an underlap reverse curve face extending from an exterior corner of the second recess cut to the interior face, and an underlap back face extending from an interior corner of the second recess cut to the exterior face;

wherein the overlap reverse curve is configured to engage with the underlap reverse curve in whole or in part when the shiplap joint is formed;

wherein the overlap reverse curve comprises a first overlap curve and a second overlap curve, wherein the first overlap curve is adjacent the respective interior face;

wherein the underlap reverse curve comprises a first underlap curve and a second underlap curve, wherein the first underlap curve is adjacent the respective interior face;

wherein the first overlap curve has a first overlap radius of curvature, the second overlap curve has a second overlap radius of curvature, the first underlap curve has a first underlap radius of curvature, and the second underlap curve has a second underlap radius of curvature.

2. The siding system of claim 1, where the engagement of the overlap reverse curve and the underlap reverse curve prevents the first and second edges of the respective panels forming the shiplap joint from separating.

3. The siding system of claim 1, where the engagement of the overlap reverse curve and the underlap reverse curve is configured to resist separation of the first and second edges of the respective panels forming the shiplap joint when subjected to a wind load.

4. The siding system of claim 1, where the engagement of the overlap reverse curve and the underlap reverse curve is configured to prevent separation of the first and second edges of the respective panels forming the shiplap joint when subjected to a pre-determined wind load.

5. The siding system of claim 1, wherein all of the radii of curvature are the same.

6. The siding system of claim 1, wherein at least one of the radii of curvature is different from one or more of the others.

7. The siding system of claim 1, wherein the first overlap radius of curvature is smaller than the first underlap radius of curvature, and the second overlap radius of curvature is larger than the second underlap radius of curvature.

8. The siding system of claim 1, wherein the second recess face comprises a longitudinal channel or groove extending some or all of the length of the respective piece of siding.

9. The siding system of claim 8, wherein the longitudinal channel or groove is configured to receive a penetrating fastener with a head with a thickness, and the channel or groove has a depth greater than the thickness of the head of the fastener.

10. The siding system of claim 8, wherein the longitudinal channel or groove has a bottom and a depth sufficient to receive a penetrating fastener with a head such that, when the fastener is fully inserted so that a bottom of the fastener head is flush with the bottom of the channel or groove, the fastener head does not extend above the plane of the second recess face.

11. The siding system of claim 1, wherein the overlap front face and the underlap back face form two sides of a gap when the shiplap joint is formed.

12. The siding system of claim 11, where the gap is angled away from the respective recess faces.

13. The siding system of claim 11, wherein the two sides are parallel.

14. The siding system of claim 11, wherein the two sides converge, and the gap is widest at the exterior faces.

15. A piece of siding, comprising:

a rectilinear board with a length, a width, an exterior face, an interior face, a first edge comprising an overlap portion of a shiplap joint with a first recess cut with a first recess face parallel to and open to the interior face, and a second edge comprising an underlap portion of the shiplap joint with a second recess cut with a second recess face parallel to and open to the exterior face;

the overlap portion comprising an overlap reverse curve face extending from an interior corner of the first recess cut to the interior face, and an overlap front face extending from an exterior corner of the first recess cut to the exterior face; and the underlap portion comprising an underlap reverse curve face extending from an exterior corner of the second recess cut to the interior face, and an underlap back face extending from an interior corner of the second recess cut to the exterior face;

wherein the overlap reverse curve comprises a first overlap curve and a second overlap curve, wherein the first overlap curve is adjacent the respective interior face;

wherein the underlap reverse curve comprises a first underlap curve and a second underlap curve, wherein the first underlap curve is adjacent the respective interior face;

wherein the first overlap curve has a first overlap radius of curvature, the second overlap curve has a second overlap radius of curvature, the first underlap curve has a first underlap radius of curvature, and the second underlap curve has a second underlap radius of curvature; and wherein at least one of the radii of curvature is different from one or more of the other radii of curvature.

16. The piece of siding of claim 15, further comprising:

a longitudinal channel or groove in the second recess face extending some or all of the length of the piece of siding, wherein the longitudinal channel or grove has a depth sufficient to receive a penetrating fastener for a "blind nail" attachment;

further wherein the overlap front face and the underlap back face are parallel to each other, and each is angled away from the respective recess face.

* * * * *